US007517287B1

(12) United States Patent
Dovel et al.

(10) Patent No.: US 7,517,287 B1
(45) Date of Patent: Apr. 14, 2009

(54) GOLF SWING IMPROVEMENT DEVICE

(76) Inventors: Kenneth Dovel, 2692 Peterborough Ct., Palm Harbor, FL (US) 34684; Roger B. Strong, 14359 Newbern Loop, Gainesville, VA (US) 20155

( * ) Notice: Subject to any disclaimer, the term of this patent is extended or adjusted under 35 U.S.C. 154(b) by 0 days.

(21) Appl. No.: 11/985,173

(22) Filed: Nov. 14, 2007

(51) Int. Cl.
*A63B 69/36* (2006.01)

(52) U.S. Cl. ..... 473/271; 473/218

(58) Field of Classification Search ..... 473/207, 473/217, 218, 257, 266, 269, 270, 271, 272, 473/273, 277
See application file for complete search history.

(56) References Cited

U.S. PATENT DOCUMENTS 4,651,994 A * 3/1987 Lee ..... 473/271
4,659,084 A * 4/1987 Vuick ..... 473/264
5,445,384 A * 8/1995 Yancey ..... 473/217
5,591,090 A * 1/1997 Kauffman, Jr. ..... 473/271
5,830,079 A * 11/1998 Hudson ..... 473/272
6,575,844 B1 * 6/2003 Gray ..... 473/277
6,638,176 B1 * 10/2003 Hayes et al. ..... 473/266
7,025,689 B2 4/2006 Infalt
7,144,340 B1 12/2006 Jones et al.
7,163,464 B2 1/2007 McKeon

* cited by examiner

*Primary Examiner*—Nini Legesse

(57) ABSTRACT

A golf swing improvement device comprises a lower leg cradle and a support means. The lower leg cradle has a radiused, curved forward surface. An alternate embodiment comprises a below-foot spacer. The spacer has, in other embodiments, an attachment means.

3 Claims, 7 Drawing Sheets

FIG 2
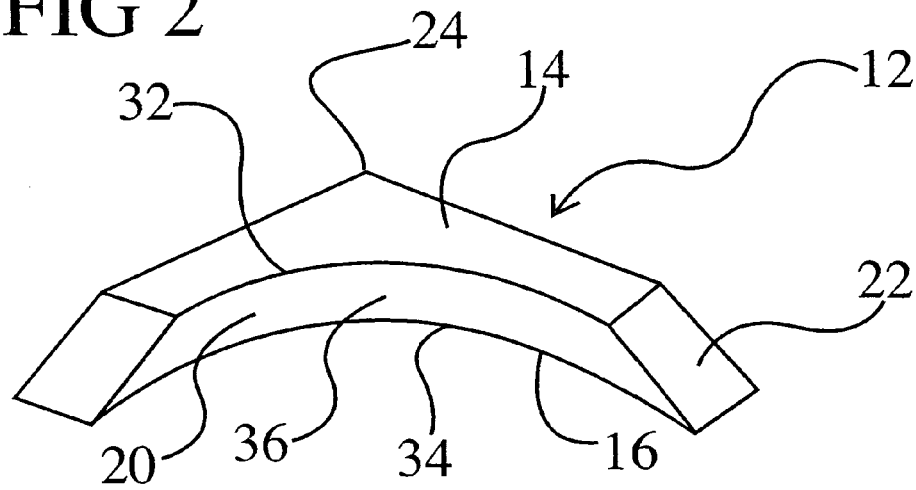
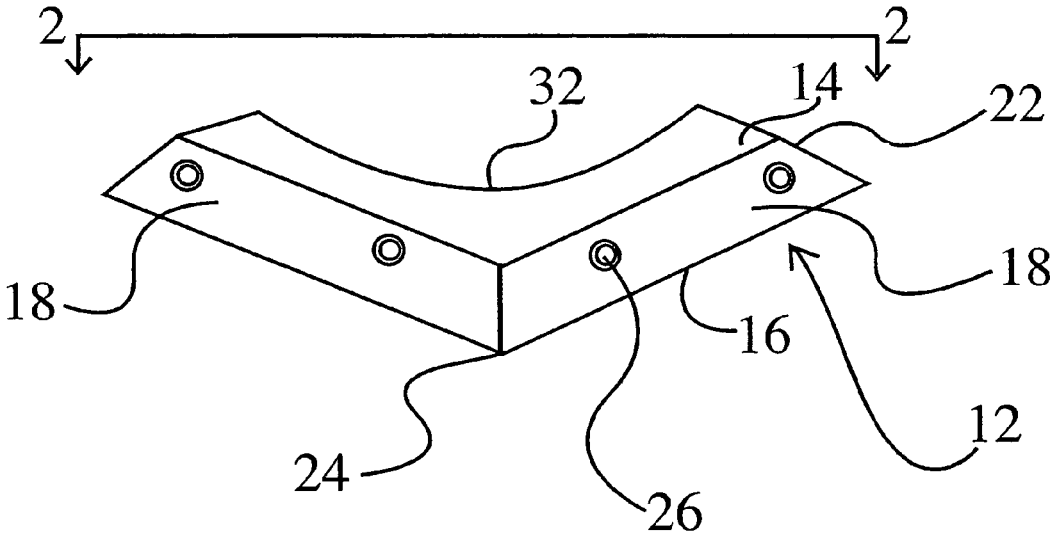
FIG 1

FIG 8
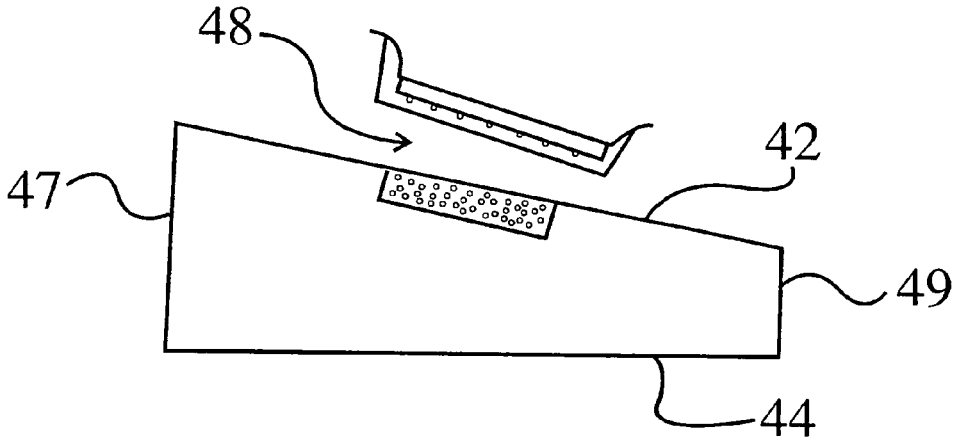
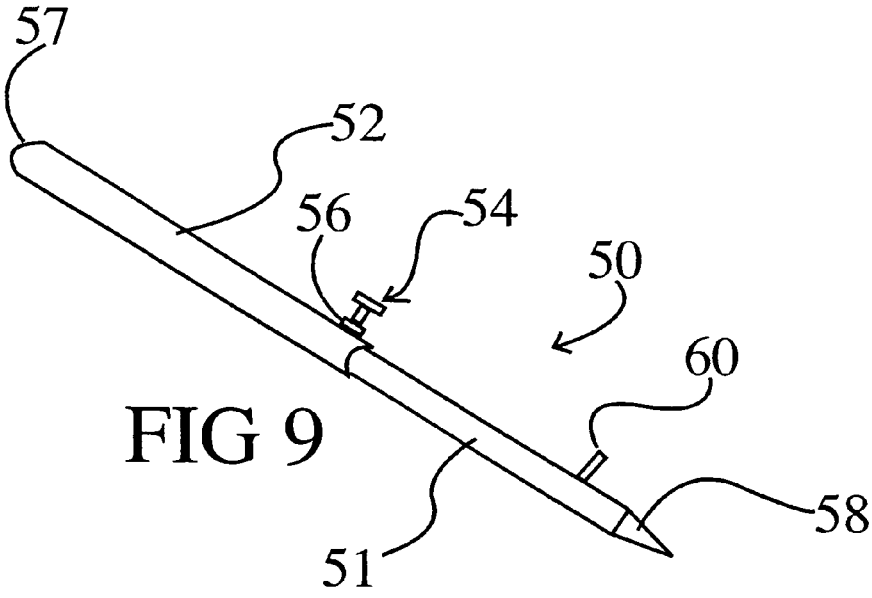
FIG 9

GOLF SWING IMPROVEMENT DEVICE

BACKGROUND OF THE INVENTION

New Rule 1.78 (F)(1) Disclosure

The Applicants have not submitted a related pending or patented non-provisional application within two months of the filing date of this present application. The invention is made by a two inventors, neither of which has filed a patent application, which is related to the present invention, within two months of the present application. This application is not under assignment to any other person or entity at this time.

FIELD OF THE INVENTION

The present invention relates to a golf swing improvement device and more particularly pertains to helping a golfer improve his or her swing.

DESCRIPTION OF THE PRIOR ART

The use of golf swing improvement devices is known in the prior art. More specifically, golf swing improvement devices previously devised and utilized for the purpose of helping a golfer improve his or her swing are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the aforementioned patents do not describe golf swing improvement device that allows helping a golfer improve his or her swing using a device as herein described.

In this respect, the golf swing improvement device, according to the present invention substantially, departs from the conventional concepts and designs of the prior art, and in doing so provides an apparatus primarily developed for the purpose of helping a golfer improve his or her swing.

Therefore, it can be appreciated that there exists a continuing need for a new and improved golf swing improvement device which can be used for helping a golfer improve his or her swing. In this regard, the present invention substantially fulfills this need.

SUMMARY OF THE INVENTION

In view of the foregoing disadvantages inherent in the known types of golf swing improvement devices now present in the prior art, the present invention provides an improved golf swing improvement device. As such, the general purpose of the present invention, which will be described subsequently in greater detail, is to provide a new and improved golf swing improvement device and method which has all the advantages of the prior art and none of the disadvantages.

To attain this, the present invention essentially comprises a golf swing improvement device comprising several components, in combination.

First provided is a lower leg cradle. The lower leg cradle is fabricated of a soft, semi rigid material. The cradle has an upper surface and a lower surface. The cradle also has two perpendicular intersecting outer side surfaces and a curved inner surface. The cradle also has two end surfaces. The outer side surfaces of the cradle each have a generally flat rectilinear configuration. Each of the lower leg cradle sides meets at a point, and forms an approximate ninety degree angle between the two side surfaces. Each of the side surfaces has a plurality of mounting holes there in.

Each of the end surfaces have a generally sloped configuration. The curved inner surface has an upper curve and a lower curve with an intermediate surface there between. The upper curve has a first radial dimension and the lower curve has a second radial dimension. The second radial dimension is greater than the first radial dimension so that the intermediate surface between the upper and lower curves has an angled configuration. The upper surface is generally planar and the lower surface is generally planar.

Next provided is a pair of support rods. The support rods are fabricated of a rigid material. Each support rod comprises a pair of telescoping portions, being an upper portion and a lower portion. The upper portion has a generally hollow tubular configuration having an upper end, a lower end, and a passageway there through. The passageway has a first internal diameter. The lower portion has a generally hollow tubular configuration having an upper end, a lower end, and a passageway there through. The lower portion has a second external diameter. The second external diameter is smaller than the first internal diameter, allowing the lower portion to slide into, and be contained with, the passageway of the upper portion. The upper end of the upper portion has a blunted end and is sized to snuggly fit into one of the mounting holes of the sides of the cradle. The lower end of the lower portion of each of the support rods having a generally tapered configuration so as to allow the pressing of the tapered end into the ground for mounting thereto.

Lastly provided is a below-foot spacer. The spacer has a generally hemi-frustral configuration, with a flat under surface and a generally curved and tapered upper surface. The spacer is fabricated of a rigid material, such as wood, plastic, metal, and composite.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf swing improvement device which has all of the advantages of the prior art golf swing improvement devices and none of the disadvantages.

It is another object of the present invention to provide a new and improved golf swing improvement device which may be easily and efficiently manufactured and marketed.

It is further object of the present invention to provide a new and improved golf swing improvement device which is of durable and reliable constructions.

An even further object of the present invention is to provide a new and improved golf swing improvement device which is susceptible of a low cost of manufacture with regard to both materials and labor, and which accordingly is then susceptible of low prices of sale to the consuming public, thereby making such golf swing improvement device economically available to the buying public.

Even still another object of the present invention is to provide a golf swing improvement device for helping a golfer improve his or her swing.

Lastly, it is an object of the present invention to provide a new and improved golf swing improvement device comprising a lower leg cradle and a support means. An alternate embodiment comprises a below-foot spacer. The spacer has, in other embodiments, an attachment means.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the device taken from the rear surface of the device.

FIG. 2 is a view taken along line 2-2 of FIG. 1.

FIG. 8 is a cross section of the below-foot spacer, showing the sole of the instep of a user's shoe with a hook and loop attachment means.

FIG. 9 is a perspective view of a support rod, showing the tapered lower end of the lower portion and the rounded upper end of the upper portion. Note the spur on the lower end of the lower portion, as described in another embodiment of the device.

The same reference numerals refer to the same parts throughout the various Figures.

DESCRIPTION OF THE PREFERRED EMBODIMENT

Figure 3:
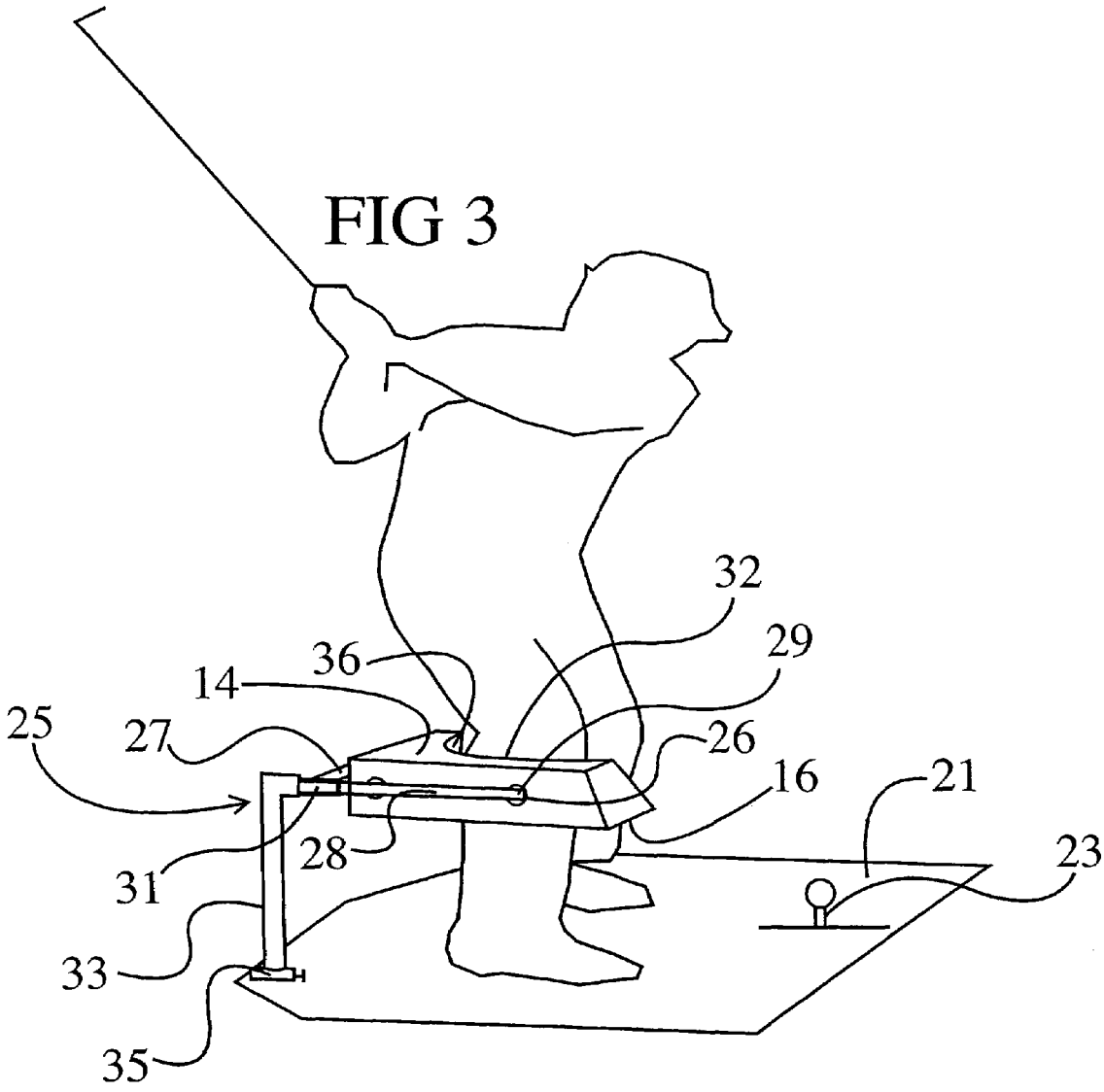
FIG. 3 is a perspective view of the device in use. Note the alternate embodiment, using a single mount with a plate and a ball tee.
Figure 4:
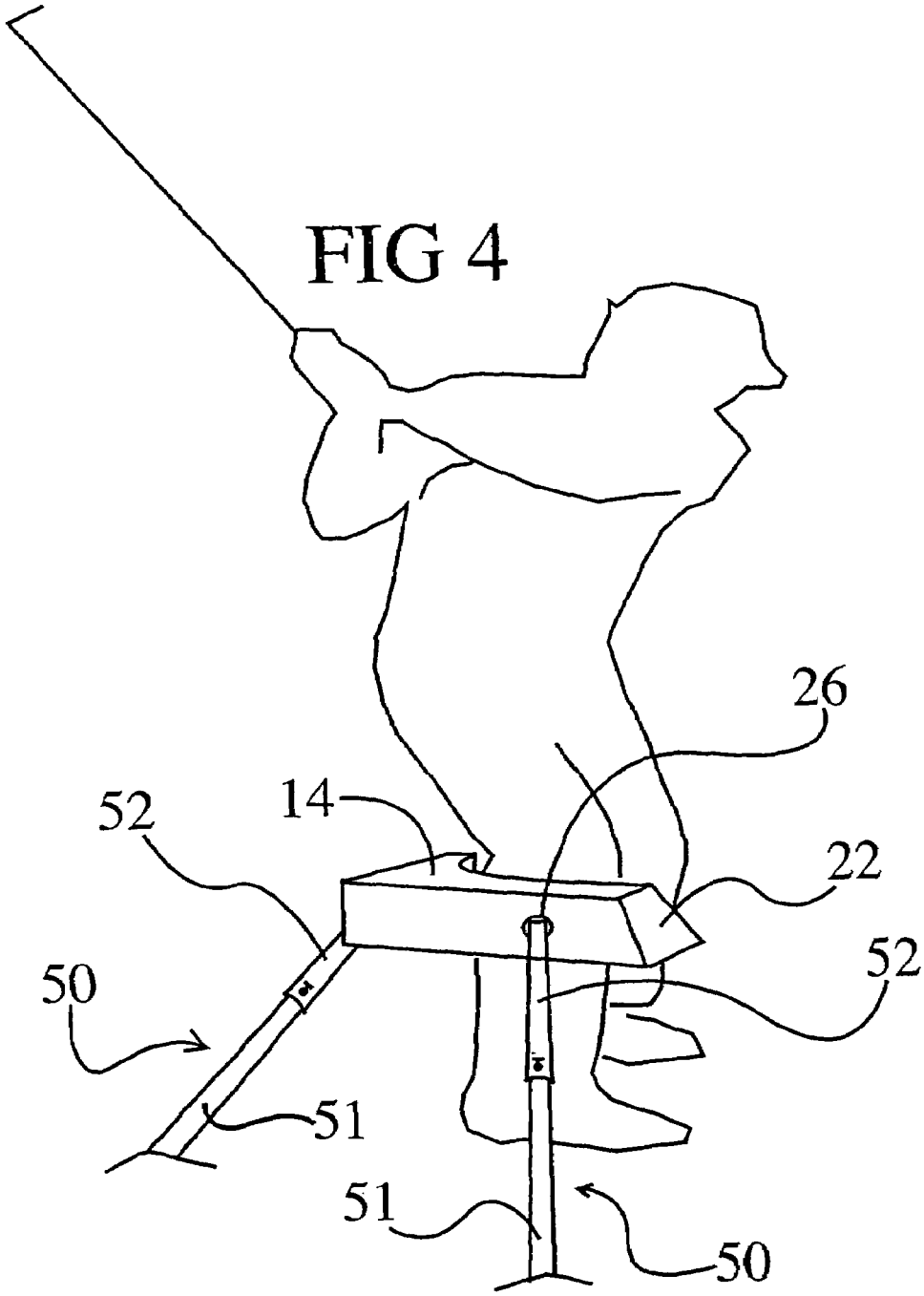
FIG. 4 is a perspective view of the preferred embodiment. Note the telescoping support rods anchored into the ground.
Figure 5:
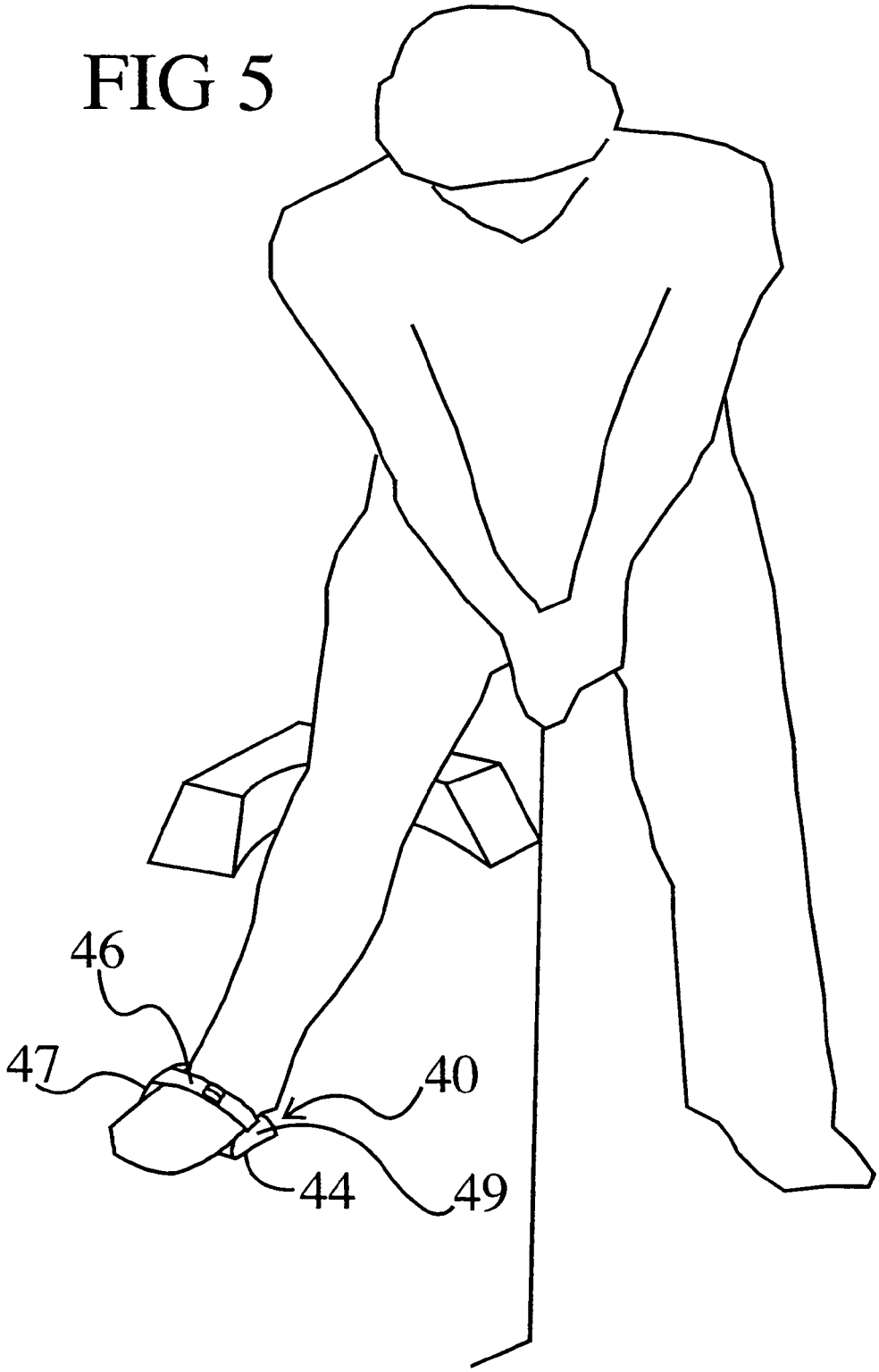
FIG. 5 is a perspective view of the device with the associated below-foot spacer. Note the orientation of the spacer and the user's foot.
Figure 6:
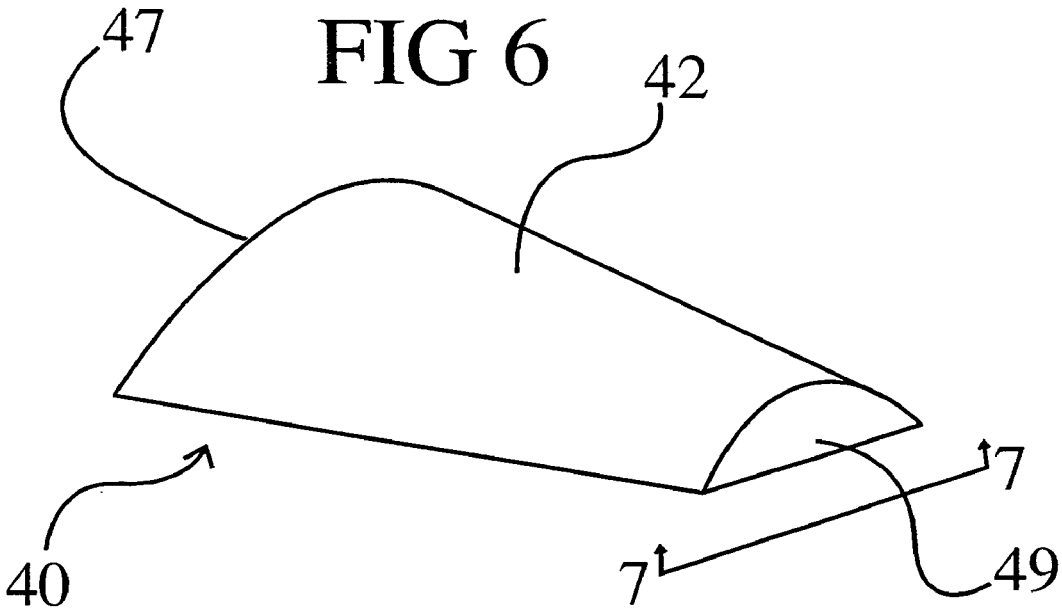
FIG. 6 is a perspective view of the below-foot spacer.
Figure 7:
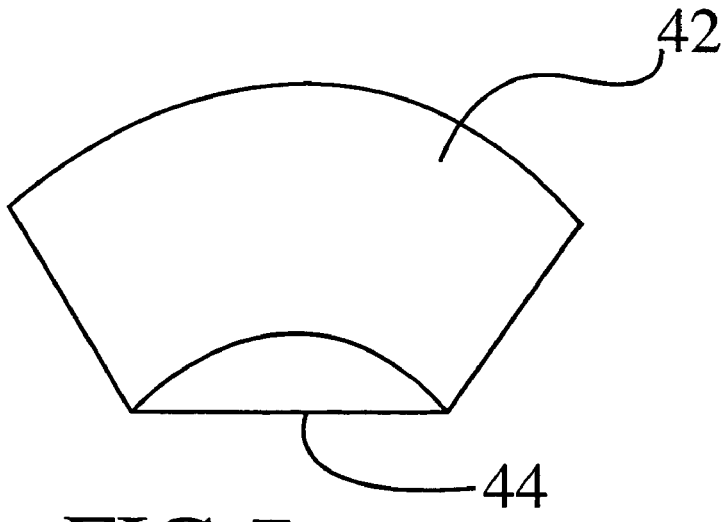
FIG. 7 is a view taken along line 7-7 of FIG. 6.
Figure 10:
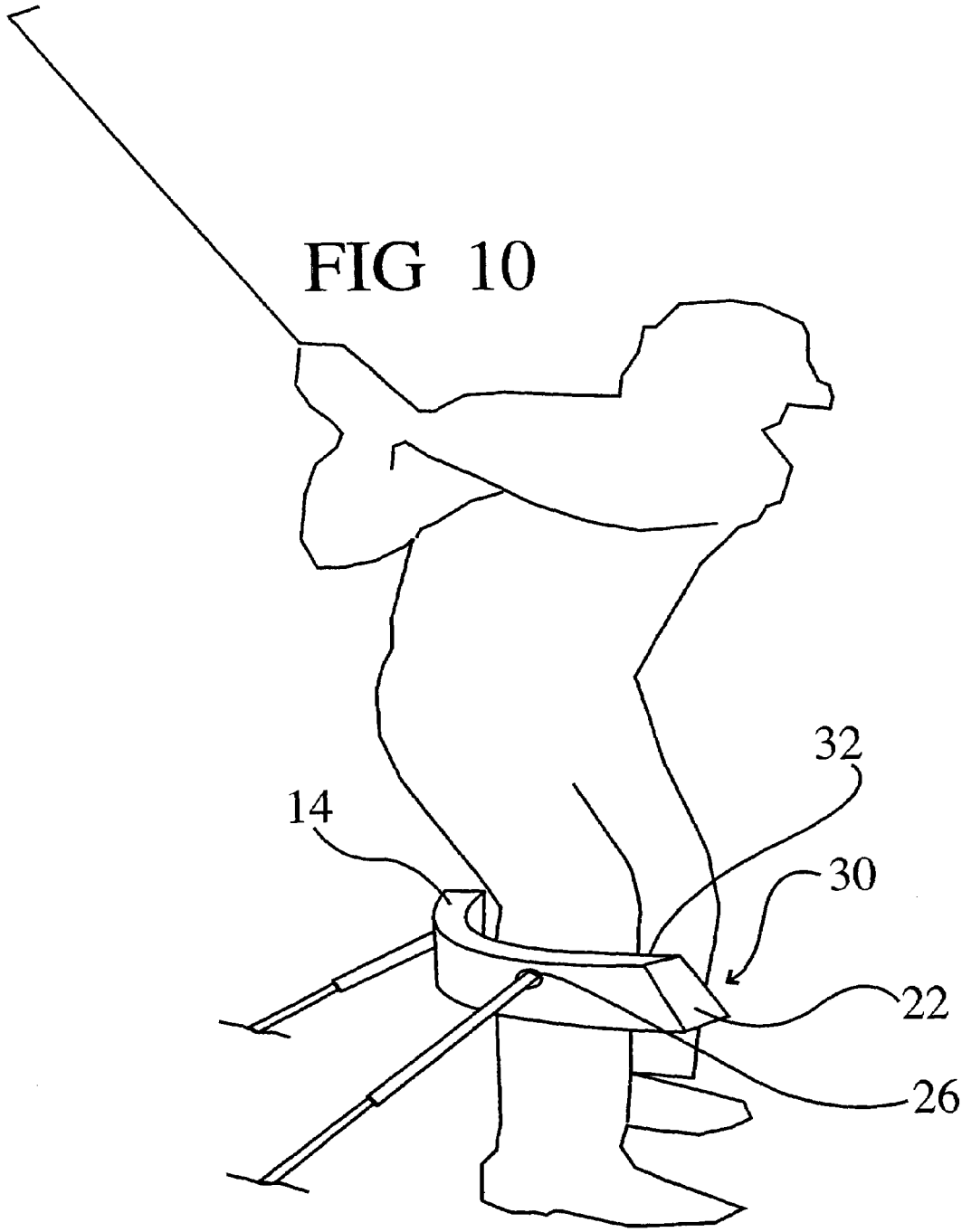
FIG. 10 is a perspective view of another embodiment of the cradle, being the semi-circular configuration.

With reference now to the drawings, and in particular to FIGS. 1 through 9 thereof, the preferred embodiment of the new and improved golf swing improvement device embodying the principles and concepts of the present invention and generally designated by the reference numeral 10 will be described.

The present invention, the golf swing improvement device 10 is comprised of a plurality of components. Such components in their broadest context include a lower leg cradle, a pair of support rods, and a below-foot spacer. Such components are individually configured and correlated with respect to each other so as to attain the desired objective.

First provided is a lower leg cradle 12. The lower leg cradle is fabricated of a soft, semi rigid material. The cradle has an upper surface 14 and a lower surface 16. The cradle also has two perpendicular intersecting outer side surfaces 18 and a curved inner surface 20. The cradle also has two end surfaces 22. The outer side surfaces of the cradle each have a generally flat rectilinear configuration. Each of the lower leg cradle sides meets at a point 24, and forms an approximate ninety degree angle between the two side surfaces. Each of the side surfaces has a plurality of mounting holes 26 there in.

The curved inner forward surface of the cradle allows the user's lower leg, the area below the user's knee, to ride within the curve. The advantage of the semi-rigid material is that the lower leg can push against it and there is "give" in the surface of the cradle. This construct allow the lower leg to have movement within the cradle.

Other devices, disclosed in the prior art, teach a rigid system. Such a system may be in the form of a surface that the user's presses against. The problem with such a device is that when removed, the ability of the user to "lean" against the device is removed, and the absence of the positive reinforcement causes a user's swing to revert back to the same problems that the swing aid was supposed to address. The soft surface of the present device acts as a "reminder" but not a constraint. The object the user must achieve is to swing through the golf swing without his or her lower leg pressing into the soft sides of the cradle. This practice makes the user more cognizant of the position of the knee and lower leg as he or she swings through. As the device is used and practiced with, the user learns to work to keep his or her knee and lower leg in proper position, and not rely on "leaning" against a device. In this way the user learns what proper positioning feels like, and is more likely to repeat the position when the device is not present. The prior art cited, in particular U.S. Pat. No. 5,591,090 to Kauffman prevents sway with a rigid forward structure. The use of the inner curved, circular configuration in the present invention corrects two golfing swing problems, being lateral sway and the straightening of the trailing leg.

In another embodiment the lower leg cradle may be coupled to a base plate 21 having a tee 23. Such configuration would be normally found at a practice range. In this other embodiment the support rods may be a single support 25 that couples to both sides of the cradle by a first rod 27 and a second rod, the first and second rods having a bend 29 at one end to couple to the cradle. The first and second rods would be coupled together by a coupling piece 31 that would be coupled to an up-tube 33. The entire assembly is pivotable about the ground contact point 35, proving a movable device.

In another embodiment, the lower leg cradle may be a semi-circular configuration 30 having mounting apertures within the sides of the semi-circle.

In the preferred embodiment, each of the end surfaces have a generally sloped configuration. The curved inner surface has an upper curve 32 and a lower curve 34 with an intermediate surface 36 there between. The upper curve has a first radial dimension and the lower curve has a second radial dimension. The second radial dimension is greater than the first radial dimension so that the intermediate surface between the upper and lower curves has an angled configuration. The upper surface is generally planar and the lower surface is generally planar.

An adjunct to the lower leg cradle is a below-foot spacer 40. The spacer has a generally hemi-frustral configuration, resembling a truncated cone which has been cut in two hemi-frustrum. The curved upper surface 42 of the spacer allow the foot to roll over the top of the spacer during the swing. The flat under surface 44 allows the spacer to be firmly interfaced with the ground. The spacer may be used in conjunction with the lower leg cradle to urge the golfer into the proper foot and knee positions. The spacer is made of a resilient, soft material, so that like the lower leg cradle which "reminds" the user of proper knee position, the spacer has enough of give to let the user become more cognizant of how his or her foot moves during their swing.

In another embodiment, the spacer may have a strap 46 that runs the length from the first flat end 47 to the second flat end 49. Using the strap, the user may place the spacer in position for the swing, and then remove it for walking in the fairway.

In other embodiments, the spacer may have an attachment means, such as a snap, hook and loop 48, adhesive, clip, wire, or pin with which to couple the spacer to the bottom of a shoe. The strap, described above, also may be considered an attachment means. The use of the hook and loop means implies that an adhesive or other attachment means will be used to couple the components of the hook and loop means to the surfaces of the user's instep sole and the below-foot spacer.

The spacer may be made of any number of materials that are either rigid or resilient, and semi-rigid. Materials such as wood, metal, plastic, rubber, latex, acrylic, polymers and composites may be used. The fabricating material may be naturally occurring, or synthetic.

Next provided is a pair of support rods 50. The support rods are fabricated of a rigid material. Each support rod comprises a pair of telescoping portions, being an upper portion and a lower portion 51. The upper portion has a generally hollow tubular configuration having an upper end, a lower end, and a passageway there through. This configuration may be referred to as a "tube". There is a locking means 54, or locking mechanism, associated with the upper portion passageway. The locking means may be a twist lock, a snap, a clip, a pin, a slide, a lug or a boss and bolt 56. The upper portion passageway has a first internal diameter.

The lower portion has a generally hollow tubular configuration having an upper end, a lower end, and a passageway there through. The lower portion has a second external diameter. The second external diameter is smaller than the first internal diameter. The upper end 57 of the upper portion has a blunted end and is sized to snuggly fit into one of the mounting holes of the sides of the cradle. The lower end 58 of the lower portion of each of the support rods having a generally tapered configuration so as to allow the pressing of the tapered end into the ground for mounting thereto.

In another embodiment the lower end of the lower portion has a foot spur 60 for allowing a user to easily press the lower portion into the ground using his or her foot.

In another embodiment the support rods may be solid.

And in still another embodiment the support rods may be solid and each rod comprising a plurality of connecting pieces, held together by a coupling means, such as a screw thread, clip, snap, pin, sleeve, collar or clamp.

In another embodiment the below-foot spacer has an associated shoe coupling attachment means. The attachment means is a clip, snap, wire, tie, cable, pin, pin and slot, lug, or thread. The strap, as described above, is also considered to be an attachment means.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf swing improvement device, comprising:

a leg cradle positionable adjacent to a user's trailing leg, the leg cradle having an exterior surface and an interior curved surface extending about 90 degrees and positioned adjacent to the outside and to the rear of a user's trailing leg, the leg cradle having an upper surface with a first radius of curvature and a lower surface with a second radius of curvature greater than its first radius of curvature; and a support member to position the leg cradle below a user's knee.

2. The golf swing improvement device as described in claim 1 wherein the device further comprises:

a below-foot spacer having a generally conical configuration with a flat under surface and a generally curved and tapered upper surface.

3. The golf swing improvement device as described in claim 1 wherein the leg cradle is fabricated of a soft, semi-rigid material.

* * * * *